US006151937A

United States Patent [19]

Buccicone et al.

[11] Patent Number: 6,151,937

[45] Date of Patent: Nov. 28, 2000

[54] MACHINE FOR FORMING T-SHAPED TUBULAR COMPONENTS USING A FORMING MATERIAL INSERT

[75] Inventors: Dana Francis Buccicone, Goshen; Robert J. Polichette, Elkhart; Ledford Samuel Stults, Mishawaka, all of Ind.; Todd Lee Sobieralski, Sr., Niles, Mich.

[73] Assignee: Amcast Industrial Corporation, Dayton, Ohio

[21] Appl. No.: 09/251,687

[22] Filed: Feb. 17, 1999

[51] Int. Cl.[7] ..... B21D 39/08

[52] U.S. Cl. ..... 72/57

[58] Field of Search ..... 72/39, 57, 58, 72/62

[56] References Cited

U.S. PATENT DOCUMENTS

| | | |
|---|---|---|
| 2,111,695 | 3/1938 | Seeber et al. . |
| 2,203,868 | 6/1940 | Gray et al. . |
| 2,238,037 | 4/1941 | Cornell, Jr. . |
| 2,603,175 | 7/1952 | Wurzburger . |
| 2,735,389 | 2/1956 | Wurzburger . |
| 2,762,326 | 9/1956 | Burkhart . |
| 2,827,007 | 3/1958 | Wurzburger . |
| 2,944,501 | 7/1960 | Stanton . |
| 2,975,510 | 3/1961 | Heuss et al. . |
| 3,209,439 | 10/1965 | Arbogast . |
| 3,383,901 | 5/1968 | Stalter . |
| 3,442,106 | 5/1969 | Gray, Jr. et al. . |
| 3,452,580 | 7/1969 | Witzig et al. . |
| 4,676,088 | 6/1987 | Okada et al. . |
| 4,741,081 | 5/1988 | Redman . |
| 4,831,861 | 5/1989 | Hofmann et al. . |
| 5,628,220 | 5/1997 | Schäfer . |
| 5,697,155 | 12/1997 | Bloecker et al. . |
| 6,029,487 | 8/1998 | Genin et al. ..... 72/58 |

FOREIGN PATENT DOCUMENTS

| | | |
|---|---|---|
| 440601 | 1/1936 | United Kingdom . |

*Primary Examiner*—Rodney A. Butler
*Attorney, Agent, or Firm*—Killworth, Gottman, Hagan, Schaeff, L L P

[57] ABSTRACT

A machine for forming T-shaped tubular components comprises a plurality of successive stations. A tubular blank having a forming material insert therein is positioned within a T-shaped die in a first station. A bulge is formed in the blank as force is applied to the ends or runs of the blank and the insert from opposing punches. Once the bulge or outlet of the T-shaped component is formed, a hollow pointed punch is driven through the outlet to open it. All of the punches are removed, the die is opened and the partially formed T-shaped component is transferred to a second station for cleaning. A broach is driven into one of the runs of the component while a punch is driven into the outlet. The forming material in the outlet is driven towards the runs of the component by the punch so that it is carried out the other one of the runs by the broach together with the forming material in the runs. The punch and broach are removed and the component is transferred to a third station for sizing one or more of the ends of the component. The component is then transferred to a fourth station for further sizing of one or more of the ends of the component. The T-shaped component is thus formed and removed from the machine. The machine is configured so that each station performs its respective forming operation on different components substantially at the same time so that components pass through the stations in succession.

25 Claims, 10 Drawing Sheets

MACHINE FOR FORMING T-SHAPED TUBULAR COMPONENTS USING A FORMING MATERIAL INSERT

BACKGROUND OF THE INVENTION

The present invention relates in general to the formation of tubular components, and, more particularly, to a multi-station machine used to form T-shaped tubular components from tubular blanks having forming material inserts.

One method of forming a T-shaped tubular component is to deform a tubular pipe through the application of internal pressure thereby causing a bulge to form. The tubular pipe, filled with an insert, such as Wood's metal, is positioned within a die having a T-shaped cavity. The portion of the T-shaped cavity not occupied by the tubular pipe is called the outlet. The tubular pipe and insert are compressed by a pair of opposing punches that engage both ends or runs of the pipe and the insert thereby forming a bulge in the pipe that extends into the outlet of the T-shaped cavity.

Once the bulge or outlet of the T-shaped tubular component is formed, the punches are removed. The tubular component is then transferred to a furnace or oil bath where it is heated to a temperature greater than the melting point of the Wood's metal so that the Wood's metal may be drained from the tubular component. The tubular component is then removed from the furnace or oil bath. Once the tubular component cools down, it is taken to another location where the top portion of the bulge is exposed by sawing or drilling. The tubular component is moved again to another location where the runs and outlet of the component are sized as desired for a particular application.

Such a method is time consuming as the tubular components are typically transferred in gross from one processing location to another. Further, it takes a relatively long period of time to remove the insert from the component as the component must first be heated to the melting point of the insert and then cooled before further processing. Furthermore, Wood's metal includes lead thereby necessitating additional process steps to ensure that the lead is completely removed from the component.

Accordingly, there is a need for a machine having a plurality of successive stations for forming T-shaped tubular components. There is a further need for such a machine in which two or more of the forming processes are carried out in a single station. There is yet a further need for such a machine in which the insert is removed without having to apply heat to the tubular component. There is still a further need for such a machine in which lead is not used during processing. There is an even further need for such a machine in which material usage is reduced by forming a tubular component having a more uniform wall thickness. Preferably, such a machine would produce a relatively large number of components in a relatively short period of time.

SUMMARY OF THE INVENTION

The present invention meets these needs by providing a machine having a plurality of successive stations for forming T-shaped tubular components. A tubular blank having a forming material insert therein is positioned within a T-shaped die in a first station. A bulge is formed in the blank as force is applied to the ends or runs of the blank and the insert from opposing punches. Once the bulge or outlet of the T-shaped component is formed, a hollow pointed punch is driven through the outlet to open it. All of the punches are removed, the die is opened and the partially formed T-shaped component is transferred to a second station for cleaning. A punch is driven into the outlet of the component while a broach is driven through the runs. The forming material in the outlet is driven towards the runs of the component by the punch so that it is carried out of the runs by the broach together with the forming material in the runs. The punch and broach are removed and the component is transferred to a third station for swaging one or more of the ends of the component. The component is then transferred to a fourth station for further sizing of one or more of the ends of the component. The T-shaped component is thus formed and removed from the machine. The machine is configured so that each station performs its respective forming operation on different components substantially at the same time so that components pass through the stations in succession.

According to a first aspect of the present invention, an apparatus for making metallic T-shaped tubular components comprises a forming station. The forming station comprises a first die having a T-shaped cavity, first and second extrusion punches positioned at opposing ends of the T-shaped cavity, and a de-capping punch positioned at an outlet portion of the T-shaped cavity. A tubular blank having a forming material insert provided therein is received within the T-shaped cavity of the first die. The first and second extrusion punches engage opposing ends of the tubular blank and upon application of force compress the tubular blank and the insert such that a bulge is formed in the tubular blank as a portion of the tubular blank is extruded through the outlet portion of the first die. The de-capping punch is driven through the outlet portion of the first die and into the bulge thereby forming a hole in the bulge. The de-capping punch is preferably hollow-pointed. The forming material insert may comprise wax or soap.

The apparatus may further comprise a cleaning station including a first securement device, a punch and a broach. A partially formed T-shaped component having runs and an outlet terminating at the hole in the bulge is transferred from the forming station to the first securement device of the cleaning station. The broach is driven into one of the runs in the partially formed T-shaped component while the punch is driven into the outlet in the partially formed T-shaped component. The broach forces forming material from the runs while the punch forces forming material from the outlet toward the runs such that with the punch and the broach fully extended, the forming material is removed from the partially formed T-shaped component. The first securement device may comprise jaws or a securement die for holding the partially formed T-shaped component during cleaning.

The apparatus may further comprise a first sizing station including a second securement device and at least one swage tool. The partially formed T-shaped component is transferred from the cleaning station to the second securement device of the first sizing station. The swage tool engages at least one of the runs and the outlet of the partially formed T-shaped component and upon application of force, reduces a diameter of one of the runs and the outlet of the partially formed T-shaped component. The second securement device may comprise jaws or a securement device for holding the partially formed T-shaped component during sizing.

The apparatus may further comprise a second sizing station including a third securement device and at least one punch. The partially formed T-shaped component is transferred from the first sizing station to the third securement device of the second sizing station. The punch is driven through at least one of the runs and the outlet of the partially formed T-shaped component thereby expanding a diameter of the same. The third securement device may comprise jaws or a securement die hold the partially formed T-shaped component during sizing.

According to another aspect of the present invention, an apparatus for making metallic T-shaped tubular components comprises a forming station, a cleaning station and a sizing station. The forming station receives a tubular blank having a forming material insert therein and is configured so as to form a bulge in the tubular blank upon the application of force on opposing ends of the tubular blank. The forming station includes a punch to form a hole through the bulge so as to form a partially formed T-shaped tubular component having runs and an outlet terminating at the hole in the bulge. The cleaning station receives the partially formed T-shaped tubular component from the forming station. The forming material is forced out of the partially formed T-shaped tubular component upon application of force through the outlet and one of the runs of the partially formed T-shaped tubular component. The sizing station receives the partially formed T-shaped tubular component from the cleaning station and is configured to adjust a diameter of at least one of the runs and the outlet of the partially formed T-shaped tubular component.

According to yet another aspect of the present invention, an apparatus for removing forming material from a T-shaped tubular component having runs and an outlet comprises a broach driven through the runs in the T-shaped component while a punch is driven through the outlet in the T-shaped component. The broach forces forming material from the runs while the punch forces forming material from the outlet toward the runs such that with the punch and the broach fully extended, the forming material is removed from the T-shaped tubular component.

According to a further aspect of the present invention, an apparatus for making metallic T-shaped tubular components comprises a forming station, a cleaning station, a first sizing station and a second sizing station. The forming station comprises a first die having a T-shaped cavity, first and second extrusion punches positioned at opposing ends of the T-shaped cavity, and a de-capping punch positioned at an outlet portion of the T-shaped cavity. A tubular blank having a forming material insert therein is received within the T-shaped cavity of the first die. The first and second extrusion punches engage opposing ends of the tubular blank and upon application of force compresses the tubular blank and the insert such that a bulge is formed in the tubular blank as a portion of the tubular blank is extruded through the outlet portion of the first die. The de-capping punch is driven through the outlet portion of the first die and into the bulge thereby forming a hole in the bulge. The cleaning station includes jaws, a punch and a broach. A partially formed T-shaped component having runs and an outlet terminating at the hole in the bulge is transferred from the forming station to the jaws of the cleaning station. The broach is driven through the runs in the partially formed T-shaped component while the punch is driven through the outlet in the partially formed T-shaped component. The broach forces forming material from the runs while the punch forces forming material from the outlet toward the runs such that with the punch and the broach fully extended, the forming material is removed from the partially formed T-shaped component. The first sizing station includes a second die and a swage tool. The partially formed T-shaped component is transferred from the cleaning station to the second die of the first sizing station. The swage tool engages one of the runs and the outlet of the partially formed T-shaped component and upon application of force, reduces a diameter of the one of the runs and the outlet of the partially formed T-shaped component. The second sizing station includes a third die and at least one punch. The partially formed T-shaped component is transferred from the first sizing station to the third die of the second sizing station. The punch is driven through at least one the runs and the outlet of the partially formed T-shaped component thereby expanding a diameter of the same.

The apparatus may further comprise a component transfer device having a plurality of grippers. The grippers transfer the metallic T-shaped components in various stages of formation simultaneously from station to station with tubular blanks being transferred to the first station and partially formed T-shaped components being transferred from the second sizing station to a holding station. Preferably, the stations perform each respective forming operation substantially simultaneously.

Accordingly, it is an object of the present invention to provide a machine having a plurality of successive stations for forming T-shaped tubular components. It is another object of the present invention to provide such a machine in which two or more of the forming processes are carried out in a single station. It is yet another object of the present invention to provide such a machine in which the insert is removed without having to apply heat to the tubular component. It is a further object of the present invention to provide such a machine in which lead is not used during processing. It is a still further object of the present invention to provide such a machine in which material usage is reduced by forming a tubular component having a more uniform wall thickness. It is a further object of the present invention to provide such a machine that produces a relatively large number of components in a relatively short period of time.

Other features and advantages of the invention will be apparent from the following description, the accompanying drawings and the appended claims.

DETAILED DESCRIPTION OF THE INVENTION

Figure 1:
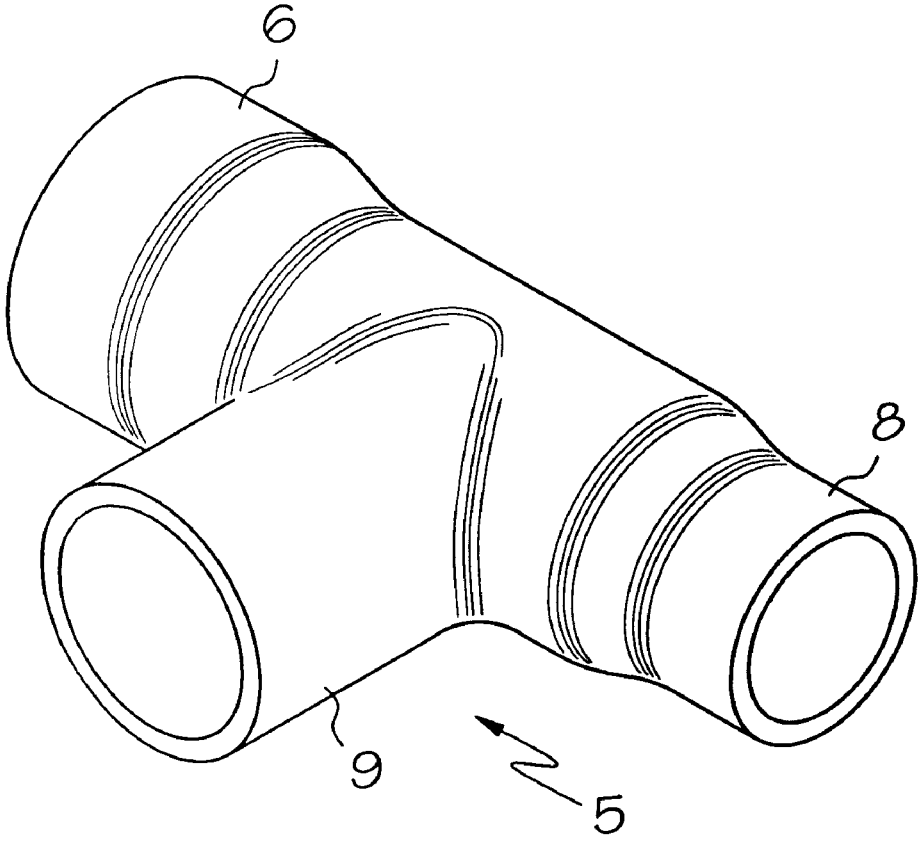
FIG. 1 illustrates a typical T-shaped component.
Figure 2:
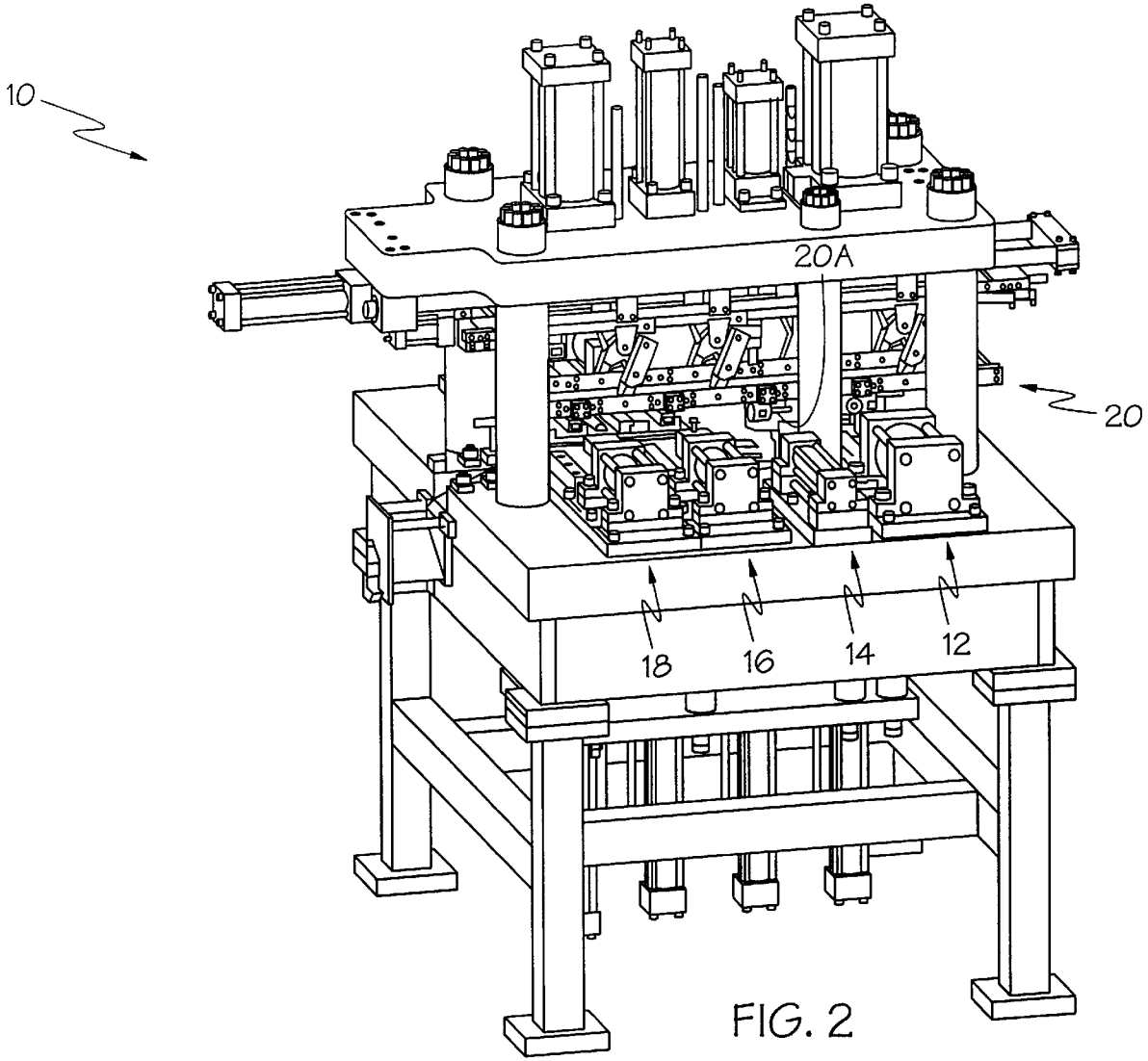
FIG. 2 is a perspective view of a machine for forming the T-shaped component of FIG. 1.

While the present invention is applicable in general to forming components having a branch extending therefrom, it will be described herein with reference to a T-shaped component formed of copper for which it is particularly attractive and in which it is initially being utilized. One such T-shaped component 5 is illustrated in FIG. 1 and includes runs 6, 8 and an outlet 9. As illustrated, the run 6 has been sized to expand the run 6 while the run 8 has been sized to reduce the run 8. Referring to FIG. 2, a machine 10 for forming the T-shaped tubular component 5 is illustrated. The machine includes a forming station 12, a cleaning station 14, a first sizing station 16, a second sizing station 18 and a component transfer device 20.

Figure 3:
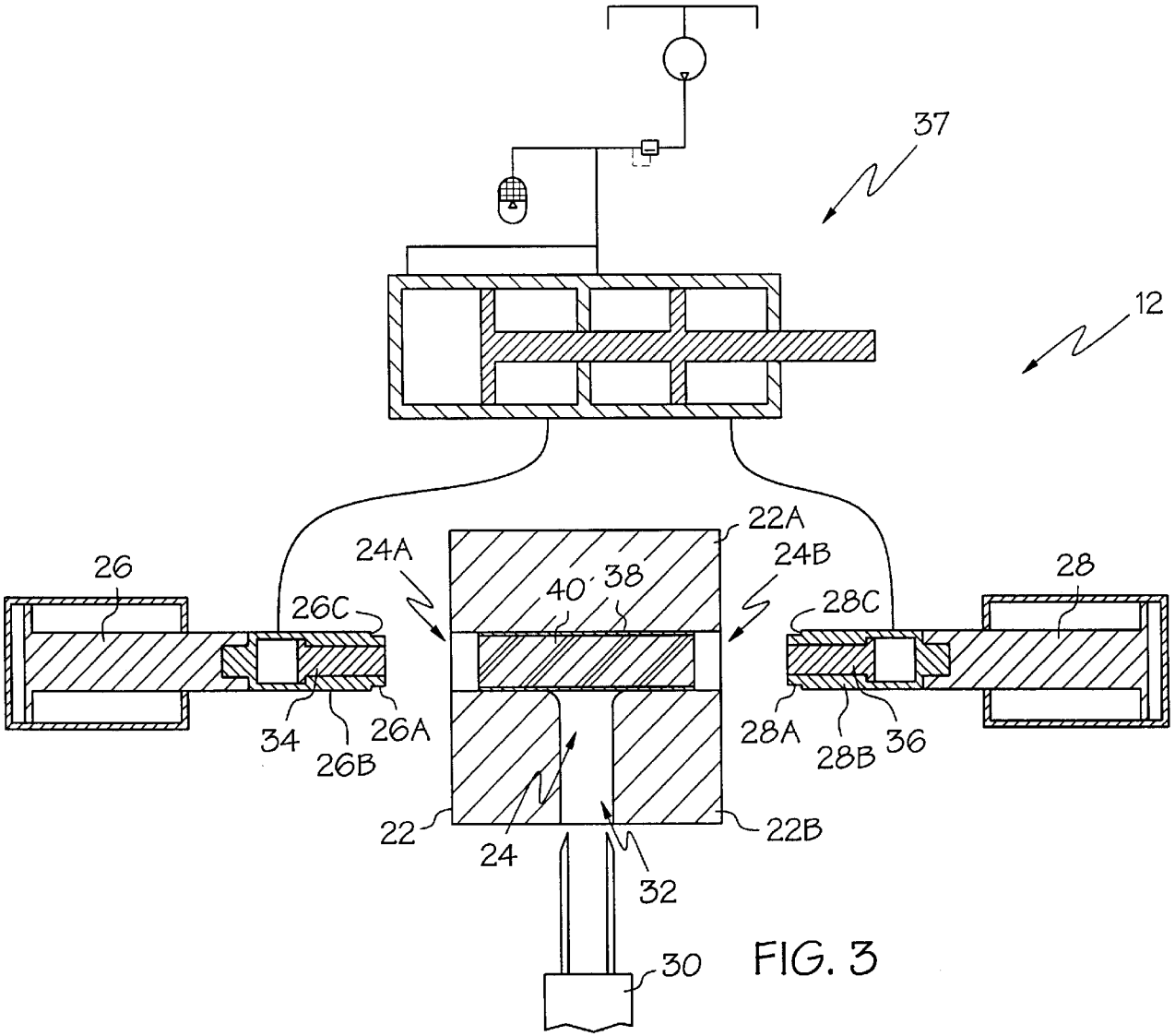
FIGS. 3–6 are cross-sectional views of a forming station of the machine of FIG. 2.

Referring to FIG. 3, the forming station 12 includes a first die 22 having a T-shaped cavity 24, a first extrusion punch 26, a second extrusion punch 28, and a hollow pointed de-capping punch 30. The first die 22 is a split die and comprises an upper portion 22A and a lower portion 22B. In the illustrated embodiment, an outlet portion 32 of the T-shaped cavity 24 is located in the lower portion 22B of the split first die 22 and is oriented downwards (down the face of the page), and thus, towards the floor as the machine 10 is shown in FIG. 1. The first and second extrusion punches 26, 28 are positioned adjacent opposing ends 24A, 24B of the T-shaped cavity 24 while the de-capping punch 30 is positioned adjacent the outlet portion 32 of the T-shaped cavity 24.

Each of the extrusion punches 26, 28 includes an internal piston 34, 36 which is concentric with the punch and moveable within the punch. The positioning of each piston 34, 36 or the pressure applied by each piston 34, 36 is controlled by hydraulic balancing apparatus 37. A first portion 26A, 28A of the extrusion punches 26, 28 has a diameter slightly smaller than a second portion 26B, 28B thereby forming a shoulder 26C, 28C.

Figure 4:
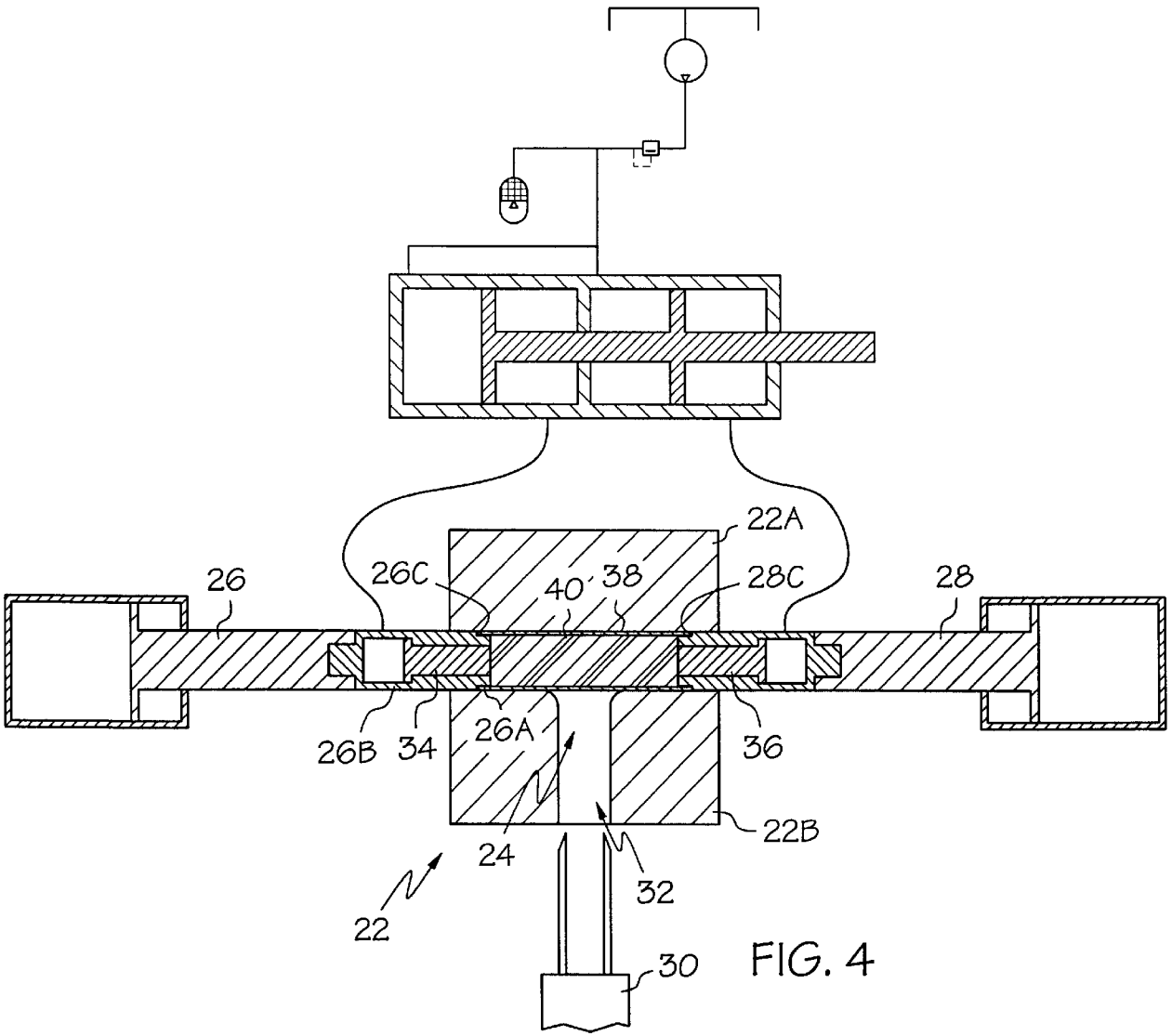

A tubular blank 38 having a forming material insert 40, such as wax, positioned therein is grasped by a set of fingers 20A on the component transfer device 20 (see FIG. 2) and transferred from an inlet chute (not shown) to the forming station 12. It will be appreciated by those skilled in the art that the insert 40 may comprise other forming materials, such as neutralized fatty acid soap or natural soap. The tubular blank 38 is released by the component transfer device 20 and positioned within the lower portion 22B of the first die 22 over the outlet portion 32. The upper portion 22A of the first die 22 is lowered onto the lower portion 22B with the portions 22A, 22B held tightly by a hydraulic arm (not shown). The portion of the T-shaped cavity 24 between the upper and lower portions 22A, 22B of the first die 22 generally corresponds to the outer diameter of the tubular blank 38. The diameters of the first portions 26A, 28A of the extrusion punches 26, 28 are also smaller than an inner diameter of the tubular blank 38. As shown in FIG. 4, the first and second extrusion punches 26, 28 are inserted into the opposing ends 24A, 24B of the T-shaped cavity 24 with the first and second portions 26A, 28A being inserted into opposing ends of the tubular blank 34 and engaging opposing ends of the insert 36 while the shoulders 26C, 28C engage the opposing ends of the tubular blank 38.

Figure 5:
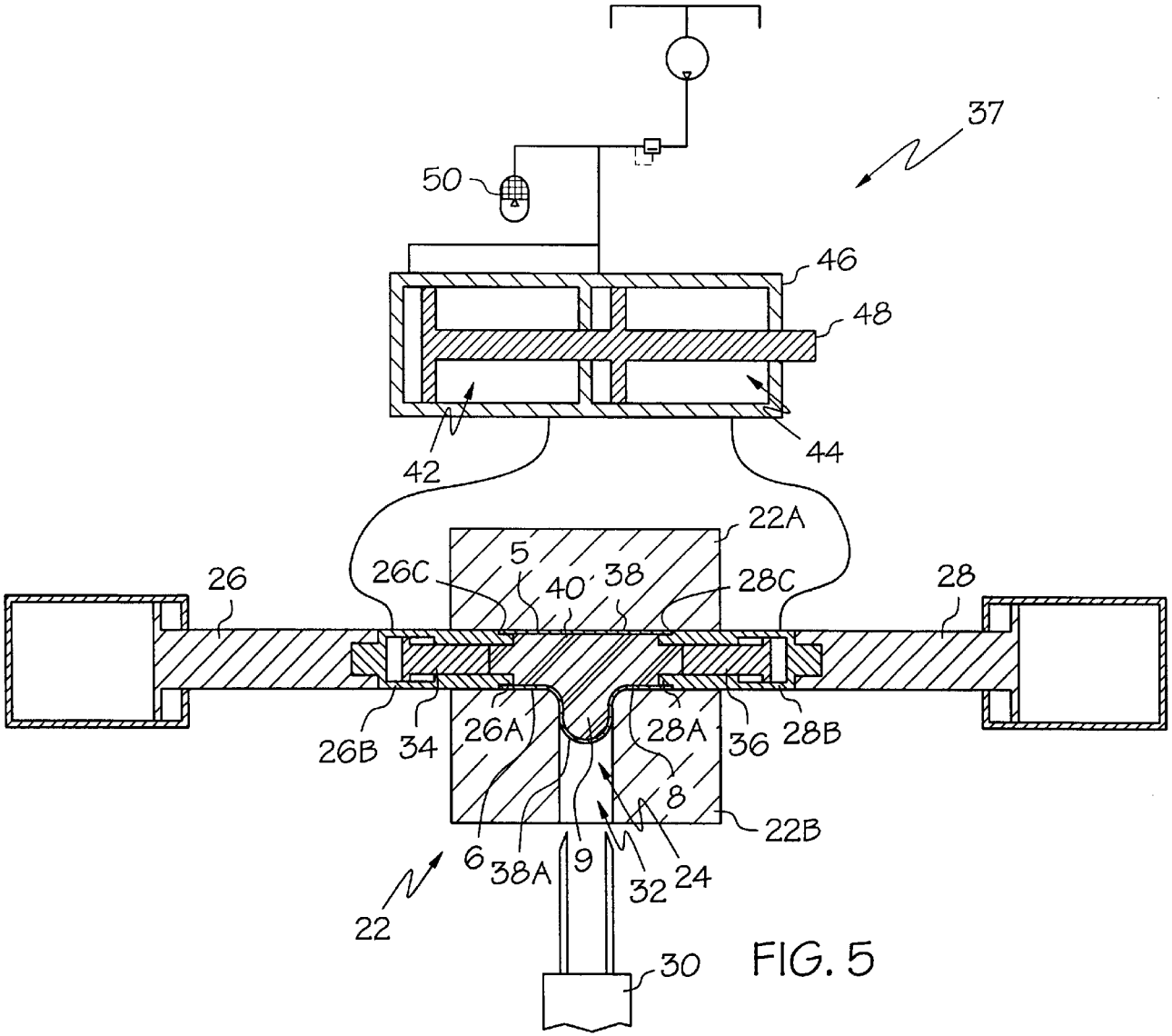

As shown in FIG. 5, the extrusion punches 26, 28 are advanced thereby compressing the tubular blank 38 and the insert 40 and causing the tubular blank 38 to extrude outward through the outlet portion 32 of the T-shaped cavity 24. A bulge 38A is thus formed as the tubular blank 38 is extruded through the outlet portion 32 of the T-shaped cavity 24. The internal volume of the tubular blank 38 decreases as the extrusion punches 26, 28 continue to advance while excess forming material from the insert 40 is received into the punches 26, 28 by pushing the respective pistons 34, 36 into the punches 26, 28 against the hydraulic forces of the hydraulic balancing apparatus 37. The hydraulic fluid, operably located behind the pistons 34, 36 in the punches 26, 28, is forced into two punch control chambers 42, 44 of a balance cylinder 46 wherein a balance piston 48 moves in one direction to force equal amounts of fluid into an accumulator 50 and moves in the other direction to receive equal amounts of fluid from the accumulator 50. Operation of the balance cylinder/piston 46, 48 minimizes unequal movement of the pistons 34, 36 within the punches 26, 28 thereby providing better control of the wall thickness of the extruded tubular blank 38. Once the punches 26, 28 are fully extended and the bulge 38A completely formed, the resulting structure corresponds to a partially formed T-shaped component 5 having runs 6, 8 and outlet 9.

Figure 6:
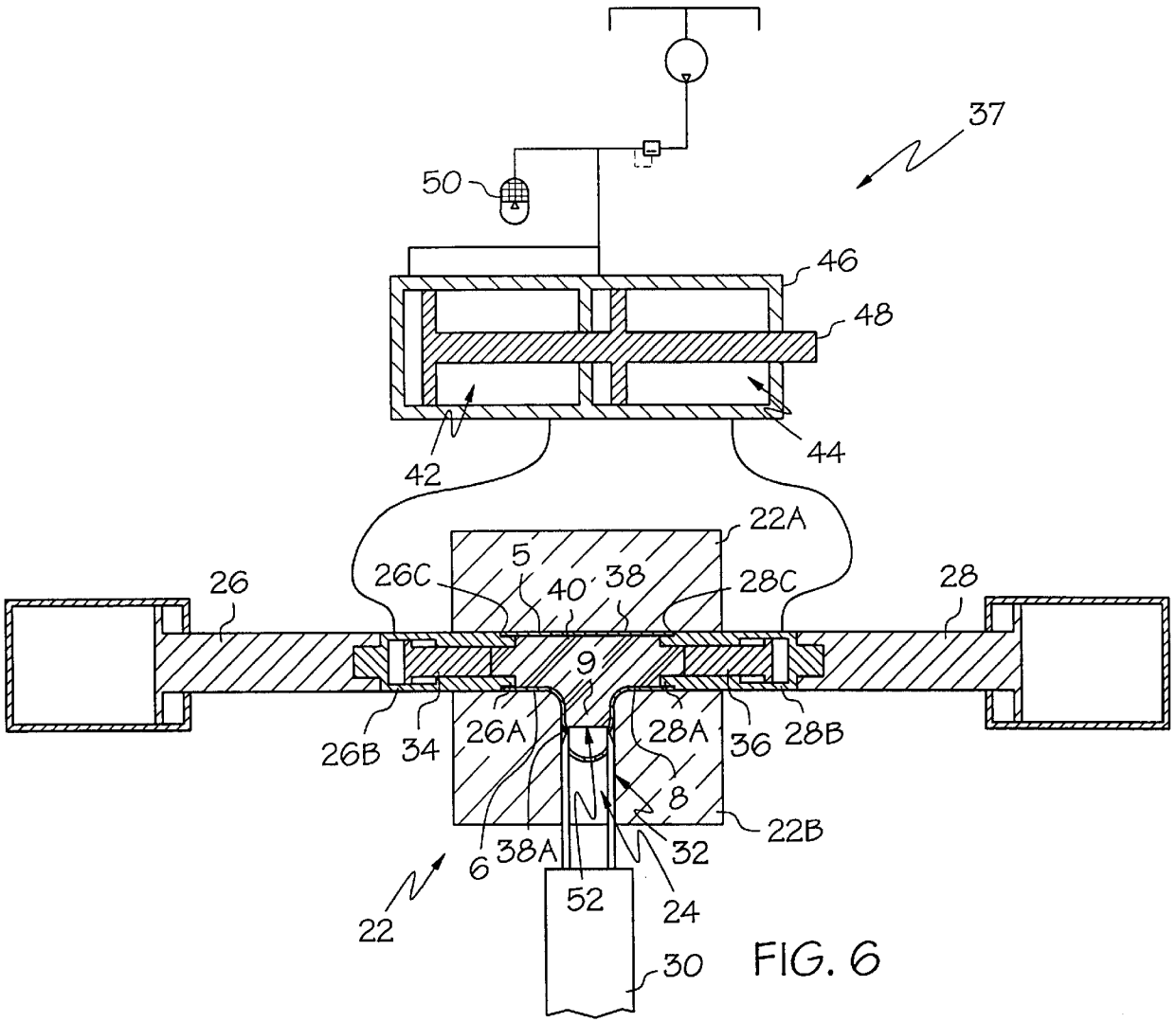

As shown in FIG. 6, an opening or hole 52 is formed in the bulge 38A as the hollow pointed de-capping punch 30 is driven up through the outlet portion 32 of the T-shaped cavity 24 and into the bulge 38A. As the name suggests, the hollow pointed de-capping punch 30 has a hollow point to facilitate removal of a portion of the bulge 38A and formation of the hole 52. In the illustrated embodiment, the de-capping punch 30 is driven into the bulge 38A with the punches 26, 28 still engaging the runs 6, 8 of the partially formed T-shaped component 5. The de-capping punch 30 is driven relatively quickly into the bulge 38A and withdrawn from the outlet portion 32 of the T-shaped cavity 24 with the removed portion of the bulge 38A falling out through the de-capping punch. The punches 26, 28 are also removed and the upper portion 22A of the first die 22 is raised exposing the partially formed T-shaped component 5. A set of fingers 20A on the component transfer device 20 grasps the partially formed T-shaped component 5 and transfers it to the cleaning station 14 while at the same time another set of fingers 20A grasps another tubular blank 38 with a forming material insert 40 from the inlet chute and transfers it to the forming station 16. It will be appreciated from the following description that the machine 10 is configured to process tubular components in succession such that each station performs its particular operation substantially simultaneously with the other stations.

Figure 9:
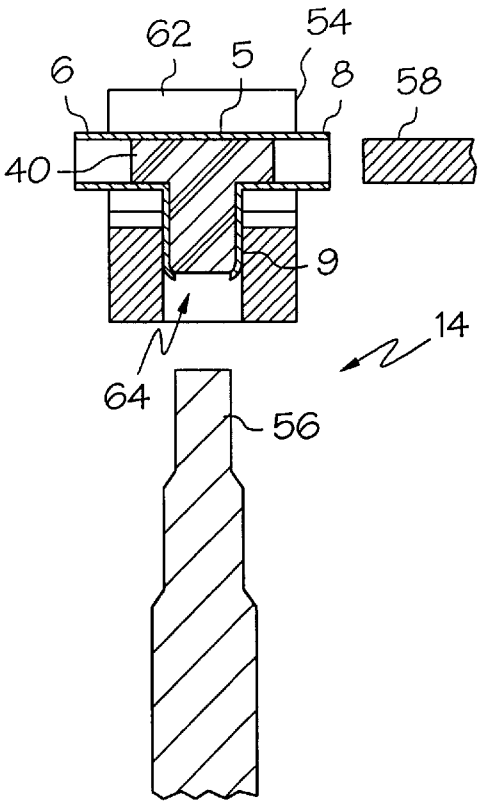
FIGS. 9 and 10 are cross-sectional views of the cleaning station of FIG. 7 including a partially formed T-shaped component.
Figure 8:
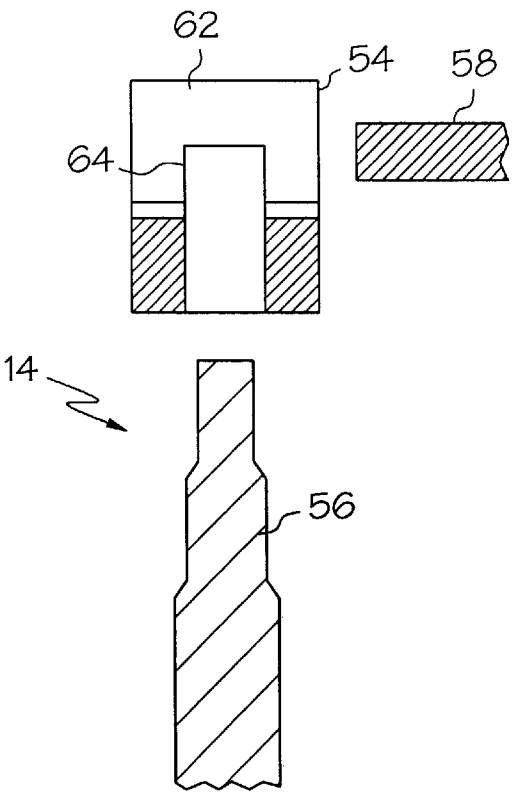
FIG. 8 is cross-sectional view of the cleaning station of FIG. 7 taken along section line 8—8.
Figure 7:
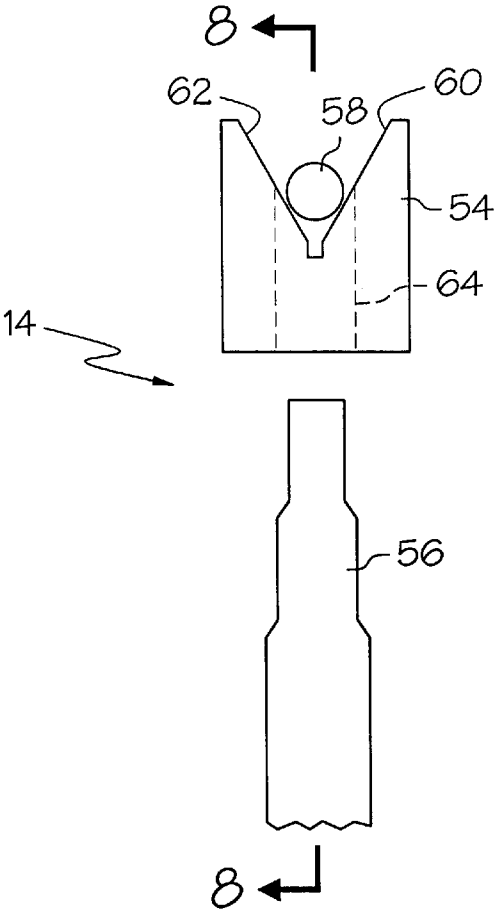
FIG. 7 is a side view of a cleaning station of the machine of FIG. 2.

As shown in FIGS. 7 and 8, the cleaning station 14 comprises a first securement device 54, a cleaning punch 56 and a broach 58. In the illustrated embodiment, the first securement device 54 comprises jaws configured to hold the partially formed T-shaped component 5 in place during cleaning. However, it will be appreciated by those skilled in the art that other securement devices, such as a die, can be used to hold the partially formed T-shaped component 5 in place. The first securement device 54 include a first gripping portion 60, a second gripping portion 62 and an outlet hole 64. As shown in FIG. 9, the outlet 9 of the partially formed T-shaped component 5 is positioned within the outlet hole 64 while the runs 6, 8 are secured between the first and second gripping portions 60, 62 by a hold down member (not shown). The punch 56 is positioned adjacent to the outlet hole 64 and the outlet 9 of the partially formed T-shaped component 5 while the broach 58 is positioned adjacent to the run 8.

Figure 10:
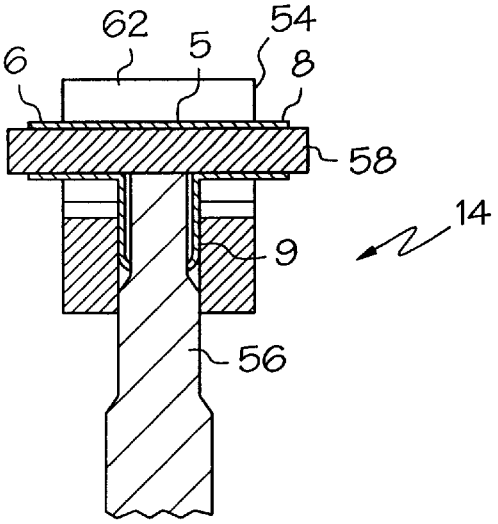

Referring now to FIG. 10, the punch 56 is driven through the outlet 9 of the partially formed T-shaped component 5 forcing the forming material in the outlet 9 towards the runs 6, 8. At the same time that the punch 56 is driven through the outlet 9, the broach 58 is driven through the runs 6, 8 of the partially formed T-shaped component 5 forcing the forming material in the runs 6, 8 and the forming material pushed up through the outlet 9 by the punch 56, out of the partially formed T-shaped component 5. Movement of the punch 56 is timed relative to the movement of the broach 58 such that the outlet 9 is cleared when the runs are approximately half-cleared. The forming material from the insert 40 is thus removed from the partially formed T-shaped component 5. The broach 58 and the punch 56 are then removed from the partially formed T-shaped component 5 while the partially formed T-shaped component 5 is released from the first securement device 54. A set of fingers 20A on the component transfer device 20 grasps the partially formed T-shaped component 5 and transfers it to the first forming station 16.

Figure 11:
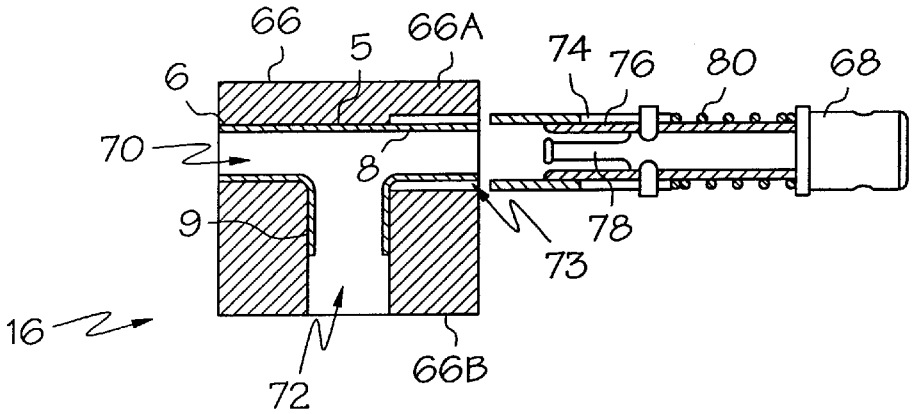
FIG. 11 is a cross-sectional view of a first sizing station of the machine of FIG. 2.

Referring to FIG. 11, the third forming station 16 comprises a second securement device 66 and a swage tool 68. The second securement device 66 comprises a second split die having an upper portion 66A and a lower portion 66B. In the illustrated embodiment, the second split die comprises a T-shaped cavity 70 with an outlet portion 72 of the T-shaped cavity 70 located in the lower portion 66B of the second securement device 66. The outlet portion 72 is oriented downwards (down the face of the page), and thus, towards the floor as the machine 10 is shown in FIG. 1. The outlet 9 of the partially formed T-shaped component 5 is positioned within the outlet portion 72 of the lower portion 66B of the second split die while the runs 6, 8 are secured between the upper and lower portions 66A, 66B of the second split die. The upper portion 66A of the second split die is lowered onto the lower portion 66B with the portions 66A, 66B held tightly together by a hydraulic arm (not shown). The portion of the T-shaped cavity 70 between the upper and lower portions 66A, 66B of the second split die generally corresponds to the shape and outer diameter of the run 6 and an additional cut-out portion 73 is provided around the run 8 to accommodate the swage tool 68 as described below. It will be appreciated by those skilled in the art that other securement devices, such as jaws, may be used to hold the partially formed T-shaped component 5 in place, depending upon the sizing operation to be performed.

In the illustrated embodiment, the swage tool 68 is positioned adjacent an end of the second split die, and specifically, adjacent to the run 8 of the partially formed T-shaped component 5. The swage tool 68 comprises an outer sleeve 74, a swaging sleeve 76, an inner stripping punch 78 and a spring 80. The outer sleeve 74 serves as a guide and a support for the swaging sleeve 76. The outer sleeve 74 is spring loaded by the spring 80. As the swage tool 68 is extended, the outer sleeve 74 extends into the portion 73 of the second split die and around the run 8. The stripping punch 78 and the swaging sleeve 76 make contact with the run 8 while the outer sleeve 74 engages the second split die and begins to retract against the force of the spring 80. The run 8 is forced over the stripping punch 78 and inside of the swaging sleeve 76 thereby reducing the outside diameter of the run 8. In the process of reducing the outside diameter of the run 8, either the length of the run 8 increases or the thickness of the wall increases.

Figure 12:
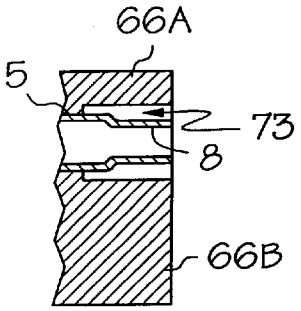
FIG. 12 is a partial cross-sectional view of the first sizing station of FIG. 11 after one of the runs of the T-shaped component has been sized or reduced.

When the swage tool 68 reaches its fully extended position, it is retracted and as this occurs, the run 8 is drawn over the stripping punch 78. The stripping punch 78 thus strips or reduces the inner diameter of the run 8 and also smooths the inner portion of the run 8 resulting in a continuous and smooth bore. As shown in FIG. 12, the outer diameter of the run 8 is reduced as a result of the swaging/sizing operation. The upper portion 66A of the second split die is raised exposing the partially formed T-shaped component 5. A set of fingers 20A on the component transfer device 20 grasps the partially formed T-shaped component 5 and transfers it to the second sizing station 18. It will be appreciated by those skilled in the art that the outer diameters of either or both of the runs 6, 8 and the outlet 9 may be reduced by swaging as required by the particular application using one or a plurality of swage tools, such as the swage tools 68, as desired.

Figure 13:
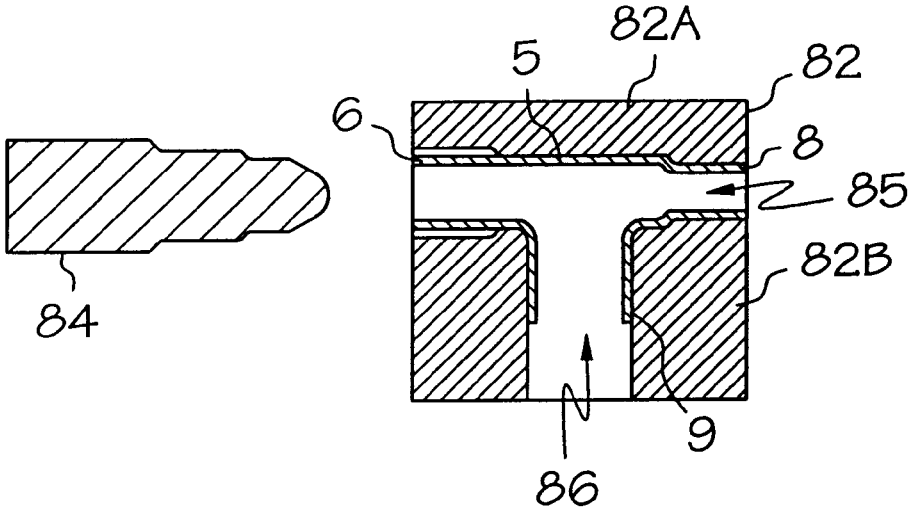
FIG. 13 is a cross-sectional view of a second sizing station of the machine of FIG. 2.

As shown in FIG. 13, the second sizing station 18 comprises a third securement device 82 and a punch 84. The third securement device 82 comprises a third split die having an upper portion 82A and a lower portion 82B. In the illustrated embodiment, the third split die comprises a T-shaped cavity 85 with an outlet portion 86 of the T-shaped cavity 85 located in the lower portion 82B of the third split die. The outlet portion 86 is oriented downwards (down the face of the page), and thus, towards the floor as the machine 10 is shown in FIG. 1. The outlet 9 of the partially formed T-shaped component 5 is positioned within the outlet portion 86 of the lower portion 82B of the third split die while the runs 6, 8 are secured between the upper and lower portions 82A, 82B of the third split die. The portion of the T-shaped cavity 85 between the upper and lower portions 82A, 82B of the third split die generally corresponds to the shape and outer diameter of the runs 6, 8 of the partially formed T-shaped component upon completion of this sizing operation. It will be appreciated by those skilled in the art that other securement devices, such as jaws, may be used to hold the partially formed T-shaped component 5 in place depending upon the sizing operation to be performed.

Figure 14:
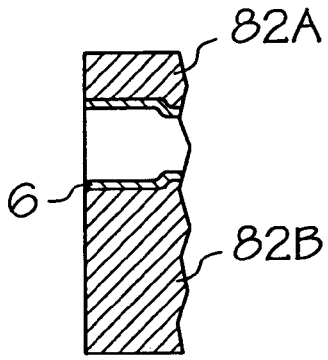
FIG. 14 is a partial cross-sectional view of the second sizing station of FIG. 13 after one of the runs of the T-shaped has been sized or expanded.

In the illustrated embodiment of FIG. 13, the punch 84 is positioned adjacent an end of the third split die, and specifically, adjacent to the run 6 of the partially formed T-shaped component 5. The diameter of the punch 84 is greater than the inner diameter of the run 6 so as to increase the inner and outer diameters of the run 6. The portion of the T-shaped cavity 85 between the upper and lower portions 82A, 82B of the third split die near the run 6 has a diameter generally corresponding to the desired outer diameter of the run 6. The punch 84 is forced into the run 6 thereby expanding the inner and outer diameters of the run 6 as shown in FIG. 14. The punch 84 is removed and the upper portion 82A of the third split die is raised exposing the now fully formed T-shaped component 5. A set of fingers 20A on the component transfer device 20 grasps the T-shaped component 5 and transfers it to holding bin (not shown). The T-shaped component 5 may be further processed if desired. It will be appreciated by those skilled in the art that the inner and outer diameters of either or both of the run 8 and the outlet 9 may be expanded as required by the particular application using one or a plurality of punches, such as the punch 84, as desired. It will be further appreciated by those skilled in the art that a run or outlet that has been swaged may also be expanded as desired.

Figure 15:
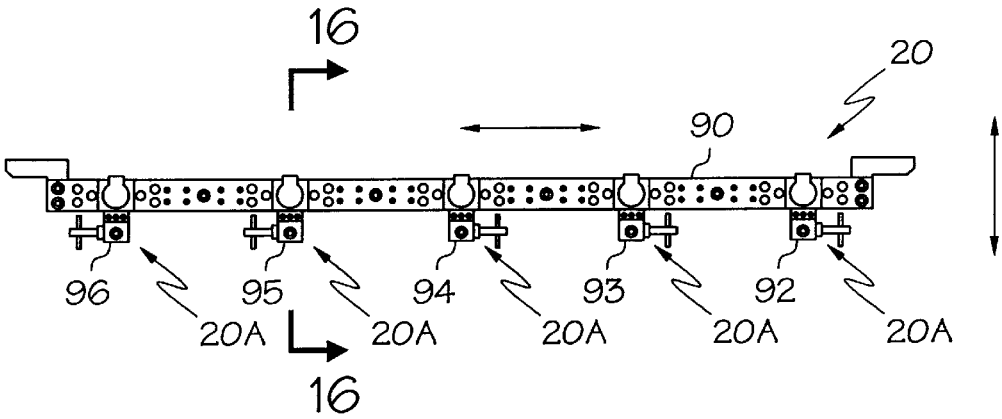
FIG. 15 is a side view of a component transfer device of the machine of FIG. 2.
Figure 16:
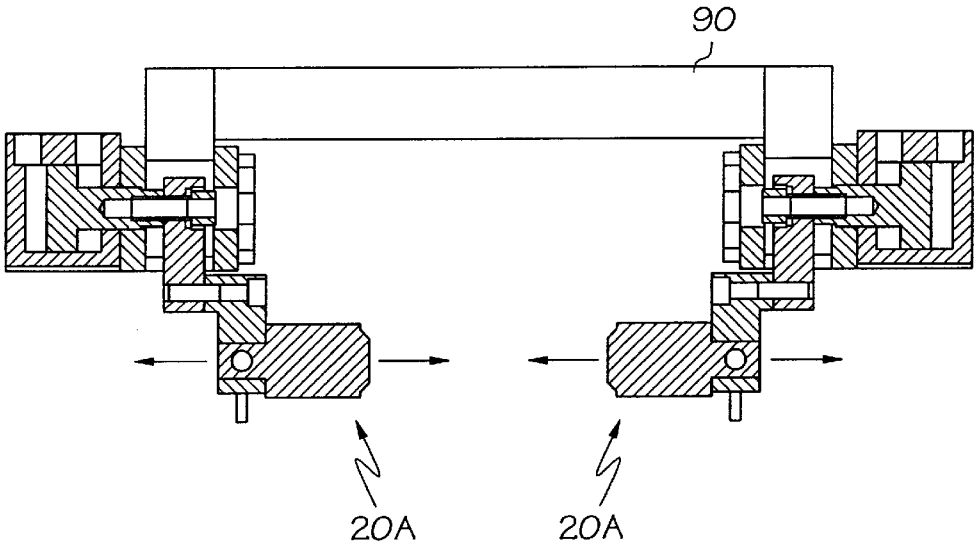
FIG. 16 is cross-sectional view of the component transfer device of FIG. 15 taken along section line 16—16.

The component transfer device 20 is illustrated in FIGS. 15 and 16. The component transfer device 20 includes an arm 90 and a plurality of engagement devices 92–96 coupled thereto. Each of the engagement devices 92–96 includes a set of the gripper fingers 20A that contract and extend so as to grasp and release the components as necessary. The arm 90 is configured to reciprocate back and forth as well as up and down. In the illustrated embodiment, at the end of an operation cycle, the arm 90 moves down so that each engagement device 92–96 can grasp a respective component between the gripper fingers 20A. Once the engagement devices 92–96 each grasps a respective component, the arm 90 moves up and over the distance of one station. The arm 90 then moves down so that the respective components can be transferred from one station to the next. The components are released by the gripper fingers 20A after which the arm

90 moves up again and back to its original position. The arm 90 therefore reciprocates back and forth as well as up and down during each transfer cycle. It will be appreciated by those skilled in the art that other component transfer devices may be used to move the components between stations.

It should be apparent that each of the stations 12, 14, 16 and 18 operate substantially simultaneously, each station performing its respective operation on one part while other parts are being simultaneously processed at the other stations. The machine 10 of the present invention allows each operation to be performed one after the other in unison without the need of transferring a plurality of partially formed components from one area to another. Further, the machine of the present invention enables a T-shaped component to be formed in the same machine from start to finish relatively quickly without having to transfer components to various locations in a manufacturing facility. It will be appreciated by those skilled in the art that the machine 10 may be configured to perform only one of the sizing operations as desired.

The bulge 38A formed by applying pressure to the insert 40 results in a rounded shape dome as compared to a square dome when Wood's metal is used in the prior art. Square domes require more material and thus longer blanks of metallic material. The use of a forming material, such as wax or soap, thus results in material savings as shorter blanks may be used. Wax and soap also have improved frictional characteristics over liquids and Wood's metal. The wall thickness of the T-shaped component is thus controlled more effectively using wax or soap in that a uniform wall is achieved without thinning in the bulge as is common when using liquids or Wood's metal. Having described the invention in detail and by reference to preferred embodiments thereof, it will be apparent that modifications and variations are possible without departing from the scope of the invention defined in the appended claims.

What is claimed is:

1. An apparatus for making metallic T-shaped tubular components, said apparatus comprising:

a forming station comprising a first die having a T-shaped cavity, first and second extrusion punches positioned at opposing ends of said T-shaped cavity, and a de-capping punch positioned at an outlet portion of said T-shaped cavity, wherein a tubular blank having a forming material insert provided therein is received within said T-shaped cavity of said first die, said first and second extrusion punches engaging opposing ends of said tubular blank and upon application of force compressing said tubular blank and said insert such that a bulge is formed in said tubular blank as a portion of said tubular blank is extruded through said outlet portion of said first die, said de-capping punch being driven through said outlet portion of said first die and into said bulge forming a hole in said bulge thereby producing a partially formed T-shaped component having runs and an outlet terminating at said hole in said bulge; and a cleaning station including a first securement device, a punch and a broach, wherein said partially formed T-shaped component is transferred from said forming station to said first securement device of said cleaning station, said broach being driven into one of said runs in said partially formed T-shaped component while said punch is driven into said outlet in said partially formed T-shaped component, said broach forcing forming material from said runs while said punch forces forming material from said outlet toward said runs such that with said punch and said broach fully extended, said forming material is removed from said partially formed T-shaped component.

2. The apparatus of claim 1, wherein said first securement device comprises jaws holding said partially formed T-shaped component during cleaning.

3. The apparatus of claim 1, wherein said first securement device comprises a securement die holding said partially formed T-shaped component during cleaning.

4. The apparatus of claim 1, further comprising a first sizing station including a second securement device and at least one swage tool, wherein said partially formed T-shaped component is transferred from said cleaning station to said second securement device of said first sizing station, said at least one swage tool engaging at least one of said runs and said outlet of said partially formed T-shaped component and upon application of force, reducing a diameter of said at least one of said runs and said outlet of said partially formed T-shaped component.

5. The apparatus of claim 1, further comprising a sizing station including a securement device and at least one punch, said partially formed T-shaped component being transferred from said cleaning station to said securement device of said sizing station, said at least one punch being driven through one of said runs and said outlet of said partially formed T-shaped component thereby expanding a diameter of the same.

6. The apparatus of claim 4, wherein said second securement device comprises jaws holding said partially formed T-shaped component during sizing.

7. The apparatus of claim 4, wherein said second securement device comprises a securement die holding said partially formed T-shaped component during sizing.

8. The apparatus of claim 4, further comprising a second sizing station including a third securement device and at least one punch, said partially formed T-shaped component being transferred from said first sizing station to said third securement device of said second sizing station, said at least one punch being driven through at least one of said runs and said outlet of said partially formed T-shaped component thereby expanding a diameter of the same.

9. The apparatus of claim 8, wherein said third securement device comprises jaws holding said partially formed T-shaped component during sizing.

10. The apparatus of claim 8, wherein said third securement device comprises a securement die hold said partially formed T-shaped component during cleaning.

11. The apparatus of claim 5, wherein said sizing station comprises a first punch and a second punch, said first punch and said second punch being driven through two of said runs and said outlet of said partially formed T-shaped component thereby expanding diameters of the same.

12. The apparatus of claim 5, wherein said sizing station comprises a first punch, a second punch and a third punch, said first punch, said second punch and said third punch being driven through corresponding ones of said runs and said outlet of said partially formed T-shaped component thereby expanding diameters of the same.

13. An apparatus for making metallic T-shaped tubular components, said apparatus comprising:

a forming station comprising a first die having a T-shaped cavity, first and second extrusion punches positioned at opposing ends of said T-shaped cavity, and a de-capping punch positioned at an outlet portion of said T-shaped cavity, wherein a tubular blank having a forming material insert therein is received within said T-shaped cavity of said first die, said first and second extrusion punches engaging opposing ends of said tubular blank and upon application of force compressing said tubular blank and said forming material insert such that a bulge is formed in said tubular blank as a portion of said tubular blank is extruded through said outlet portion of said first die, said de-capping punch being driven through said outlet portion of said first die and into said bulge thereby forming a hole in said bulge;

a cleaning station including jaws, a punch and a broach, wherein a partially formed T-shaped component having runs and an outlet terminating at said hole in said bulge is transferred from said forming station to said jaws of said cleaning station, said broach being driven through said runs in said partially formed T-shaped component while said punch is driven through said outlet in said partially formed T-shaped component, said broach forcing forming material from said runs while said punch forces forming material from said outlet toward said runs such that with said punch and said broach fully extended, said forming material is removed from said partially formed T-shaped component;

a first sizing station including a second die and a swage tool, wherein said partially formed T-shaped component is transferred from said cleaning station to said second die of said first sizing station, said swage tool engaging one of said runs and said outlet of said partially formed T-shaped component and upon application of force, reducing a diameter of said one of said runs and said outlet of said partially formed T-shaped component; and a second sizing station including a third die and at least one punch, said partially formed T-shaped component being transferred from said first sizing station to said third die of said second sizing station, said at least one punch being driven through at least one said runs and said outlet of said partially formed T-shaped component thereby expanding a diameter of the same.

14. The apparatus of claim 13, further comprising a component transfer device, said component transfer device comprising a plurality of grippers, said grippers transferring said metallic T-shaped components in various stages of formation simultaneously from station to station with tubular blanks being transferred to said first station and partially formed T-shaped components being transferred from said second sizing station to a holding station.

15. The apparatus of claim 13, wherein said stations perform each respective forming operation substantially simultaneously.

16. An apparatus for removing forming material from a T-shaped tubular component having runs and an outlet, said apparatus comprising:

a broach driven through said runs in said T-shaped component while a punch is driven through said outlet in said T-shaped component, said broach forcing forming material from said runs while said punch forces forming material from said outlet toward said runs such that with said punch and said broach fully extended, said forming material is removed from said T-shaped tubular component.

17. The apparatus of claim 16, wherein said forming material insert comprises wax.

18. The apparatus of claim 16, wherein said forming material insert comprises soap.

19. An apparatus for making metallic T-shaped tubular components, said apparatus comprising:

a forming station comprising a first die having a T-shaped cavity, first and second extrusion punches positioned at opposing ends of said T-shaped cavity, and a de-capping punch positioned at an outlet portion of said T-shaped cavity, wherein a tubular blank having a forming material insert provided therein is received within said T-shaped cavity of said first die, said first and second extrusion punches engaging opposing ends of said tubular blank and upon application of force compressing said tubular blank and said insert such that a bulge is formed in said tubular blank as a portion of said tubular blank is extruded through said outlet portion of said first die, while said extrusion punches are engaged in said opposing ends of said tubular blank and while said de-capping punch is driven through said outlet portion of said first die and into said bulge thereby forming a hole in said bulge thereby producing a partially formed T-shaped component having runs and an outlet terminating at said hole in said bulge.

20. The apparatus of claim 19, wherein said de-capping punch has a hollow point.

21. The apparatus of claim 19, wherein said forming material insert comprises wax.

22. The apparatus of claim 19, wherein said forming material insert comprises soap.

23. An apparatus for making metallic T-shaped tubular components, said apparatus comprising:

a forming station receiving a tubular blank having a forming material insert therein, said forming station configured so as to form a bulge in said tubular blank upon the application of force on opposing ends of said tubular blank, said forming station including a punch to form a hole through said bulge thereby forming a partially formed T-shaped tubular component having runs and an outlet terminating at said hole in said bulge;

a cleaning station receiving said partially formed T-shaped tubular component from said forming station, said forming material being forced out of said partially formed T-shaped tubular component upon application of force through said outlet and one of said runs of said partially formed T-shaped tubular component; and a sizing station receiving said partially formed T-shaped tubular component from said cleaning station, said sizing station configured to adjust a diameter of at least one of said runs and said outlet of said partially formed T-shaped tubular component.

24. The apparatus of claim 23, wherein said cleaning station comprises a securement device, a punch and a broach, said jaws holding said partially formed T-shaped component as said broach is driven through one of said runs in said partially formed T-shaped component and said punch is driven through said outlet in said partially formed T-shaped component, said broach forcing forming material from said runs while said punch forces forming material from said outlet toward said runs such that with said punch and said broach fully extended, said forming material is removed from said partially formed T-shaped component.

25. The apparatus of claim 24, wherein said securement device comprises a die holding said partially formed T-shaped component during cleaning.

* * * * *